US009128419B2

(12) United States Patent
Horemans et al.

(10) Patent No.: US 9,128,419 B2
(45) Date of Patent: Sep. 8, 2015

(54) SYSTEM AND METHOD FOR APPLYING LIQUID TONER TO A DEVELOPING MEMBER IN A DIGITAL PRINTER

(71) Applicant: Xeikon IP BV, Eede (NL)

(72) Inventors: Nick Horemans, Noorderwijk (BE); Maarten Achten, Zonhoven (BE); Jurgen Norbert Bart Devlieghere, Borgerhout (BE)

(73) Assignee: Xeikon IP B.V., Eede (NL)

( * ) Notice: Subject to any disclaimer, the term of this patent is extended or adjusted under 35 U.S.C. 154(b) by 0 days.

(21) Appl. No.: 14/475,193

(22) Filed: Sep. 2, 2014

(65) Prior Publication Data

US 2015/0063871 A1 Mar. 5, 2015

(30) Foreign Application Priority Data

Sep. 4, 2013 (EP) ..... 13182923

(51) Int. Cl.
*G03G 15/20* (2006.01)
*G03G 15/10* (2006.01)
*G03G 15/11* (2006.01)

(52) U.S. Cl.
CPC ..... *G03G 15/104* (2013.01); *G03G 15/11* (2013.01)

(58) Field of Classification Search
USPC ..... 399/107, 110, 119, 120, 222, 237–240
See application file for complete search history.

(56) References Cited

U.S. PATENT DOCUMENTS

| | | | | |
|---|---|---|---|---|
| 3,955,533 | A | 5/1976 | Smith et al. | |
| 2002/0098016 | A1* | 7/2002 | Kurotori et al. | 399/237 |
| 2002/0197083 | A1* | 12/2002 | Yoshino et al. | 399/237 |
| 2007/0092300 | A1 | 4/2007 | Aruga et al. | |
| 2007/0160391 | A1 | 7/2007 | Takano et al. | |
| 2013/0177337 | A1 | 7/2013 | Momotani | |
| 2014/0016966 | A1 | 1/2014 | Devlieghere et al. | |

FOREIGN PATENT DOCUMENTS

| | | | |
|---|---|---|---|
| EP | 2216692 | A2 | 8/2010 |
| EP | 2685322 | A1 | 1/2014 |
| JP | 2000275972 | A | 10/2000 |
| JP | 2005315964 | A | 11/2005 |
| JP | 2009175425 | A | 8/2009 |

* cited by examiner

*Primary Examiner* — Hoan Tran
(74) *Attorney, Agent, or Firm* — The Webb Law Firm

(57) ABSTRACT

A system for applying liquid toner to a developing member in a digital printer. The system includes a reservoir for storing liquid toner, a feed member and a developing member. The feed member is arranged to rotate to transfer liquid toner from the reservoir to the developing member. The system includes a feed assist member. The feed member is arranged for rotating in contact with the feed assist member and making contact with the feed assist member along a contact area which is located, when the system is operational, in the liquid toner in the reservoir. The feed assist member is provided with a compressible contact portion arranged for being compressed in the contact area between the feed member and the feed assist member.

20 Claims, 4 Drawing Sheets

SYSTEM AND METHOD FOR APPLYING LIQUID TONER TO A DEVELOPING MEMBER IN A DIGITAL PRINTER

CROSS-REFERENCE TO RELATED APPLICATION

This application claims priority to European Patent Application No. 13 182 923.6 filed Sep. 4, 2013, the disclosure of which is hereby incorporated in its entirety by reference.

BACKGROUND OF THE INVENTION

1. Field of the Invention

The present invention pertains to a system and method for applying liquid toner to a developing member in a digital printer, and to a digital printing apparatus comprising such a system.

2. Description of Related Art

In a conventional wet-type developing apparatus a rotating feed member, e.g. an anilox roller, immersed in a liquid toner tray, provides a constant volume of liquid toner per unit peripheral length to the developing member. The anilox roller is typically doctored by a blade before contacting the development member. The developing member brings the liquid toner into contact with a photoconductor containing an electrostatic image in order to develop that image. E.g. flexography and gravure printing presses use anilox rollers with high screen resolutions in order to create ink layers in one pass. Typically, it is desirable to apply on the anilox roller a sufficiently thick ink layer with a constant thickness, in order to realize a good constant image quality (IQ) and to ensure a stable printing process.

SUMMARY OF THE INVENTION

Embodiments of the invention are inter alia based on the following inventive insight. In embodiments where the feed member is an anilox roller, the anilox roller is partly immersed in the liquid toner. The non-immersed part is surrounded by air, so that air will enter in the recesses of the anilox pattern. The presence of air will hinder the filling of the recesses with liquid toner, resulting in a non-optimal feeding of liquid toner to the developing member. Also, liquid toner may become "trapped" in the recesses. Such "dead" toner is no longer offered properly to the developing member and contaminates the system. Especially, in cases where the toner has a strong anisotropic character, such as non Newtonian viscosity behavior, the non-flowing dead toner has a high viscosity and will thus remain largely in the recesses of the anilox roller. This further deteriorates the feeding of liquid toner to the developing roller. In other embodiments of the invention the feed member is a roller with a flat outer surface, such as a metal roller. Also in such embodiments small quantities of non flowing dead toner may remain present on the feed roller which may hinder the feeding of the liquid toner to the developing roller.

It is therefore an object of embodiments of the present invention to provide a system and method for applying liquid toner to a developing member in a digital printer, which does not have the aforementioned drawbacks.

According to an aspect of the present invention, there is provided a system for applying liquid toner to a developing member in a digital printer. The system comprises a reservoir for storing liquid toner, a feed member and a developing member, the feed member is arranged to transfer liquid toner from the reservoir to the developing member. The system further comprises a feed assist member arranged in the reservoir. The feed member is arranged for rotating in contact with the feed assist member and for making contact with the feed assist member along a contact area which is located, when the system is operational, in the liquid toner in the reservoir. The feed assist member is provided with a compressible contact portion arranged for being compressed in the contact area between the feed member and the feed assist member. Typically, the contact portion is elastically deformable, and the contact portion is arranged in such a manner that it is elastically compressible by the feed member.

When a surface part of the feed member comes in contact with the feed assist member, first this surface part moves in a pressure zone where the pressure increases, and next in a pressure relief zone where the pressure decreases. In the pressure zone any contamination on the surface part of the feed member is removed. For the case where the feed member is an anilox member, also any trapped air is removed from the recesses of the anilox pattern. In the pressure relief zone fresh liquid toner from the reservoir is applied to the feed member. In the case of an anilox member, any removed air will be replaced by fresh liquid toner. More in particular, embodiments of the invention will allow fresh liquid toner to be sucked into the recesses of the anilox pattern. More generally, the feed assist member will cause the liquid toner in the reservoir to move in the area of the feed member due to pressure variations. In the case of an anilox roller, the liquid toner in the recesses of the anilox pattern and surrounding the anilox pattern will be moved and agitated due to pressure variations and air migration. This movement will reduce significantly the viscosity of the liquid toner facilitating the filling of the recesses in the anilox roller.

Typically the feed member is a feed roller or belt, and preferably the feed member is an anilox roller. More preferably the feed roller is an anilox roller with an open pattern such as a tri-helical anilox pattern. Such an open structure will facilitate the movement of the toner in the recesses of the anilox pattern. However, the invention is also very useful in combination with anilox patterns with a closed structure, such as a honey comb pattern. The compressible contact portion of the feed assist member is preferably adapted for partially extending in the recesses of the anilox roller in the contact area between the feed assist member and the anilox roller.

Preferably, the feed assist member is a feed assist roller or belt. Preferably the feed assist roller or belt is arranged for rotating in the same direction as the feed member, seen at the contact area between the feed member and the feed assist member. In a particularly advantageous embodiment the feed assist roller or belt is arranged for being rotated through contact with the feed member. In that way the feed assist roller or belt does not have to be motorized.

In embodiments where the feed assist member is a roller or belt, the contact portion may be provided in the form of a contact layer having a circumferential outer surface making contact with the feed member in the contact area. It is noted that the contact layer may be a relatively thin outer layer, but that it is also possible to have a feed assist roller which comprises a thick contact layer of elastically deformable material arranged around the axis of the feed assist roller.

In a typical embodiment the compressible contact portion has an Asker C hardness between 10 and 50, preferably between 15 and 45, more preferably between 20 and 30. Preferably the contact portion is manufactured from a foam material, e.g. a polyurethane foam or a silicone foam. More generally, the contact portion may be manufactured from any suitable polymeric material, e.g. any one of the following materials: aromatic or alifactic polymeric rubbers, such as SBR, EPDM or neoprene; chlorosulphon polyethylene materials; nitrile rubbers; silicone rubbers; fluorosilicone rubbers; polyimide; polyamide; perfluororubber materials; polyurethanes; crosslinked epoxyresins; polyacryclic; or any combination of those materials. Also, the contact portion may be a multilayer structure made of different materials. The material is chosen for being incompatible with the liquid toner, in order to limit or prevent deterioration or modification of the contact portion. Being "incompatible" means in this context that the oil of the liquid toner should not change significantly the mechanical properties or integrity of the elastically compressible rubbing material of the contact portion, e.g. by changing significantly the hardness. However, note that minor changes in physical state such as a little swelling of the material of the contact portion may be tolerable.

In a preferred embodiment the contact portion is adapted to absorb liquid toner by capillary action. This may be achieved by choosing a suitable foam material, or more generally by providing the contact portion in a material with a suitable open-cell structure. In that way fresh toner may be taken up in the feed assist member and applied by the feed assist member on the feed member.

According to other embodiments the contact portion takes the form of a brush portion made up of bristles. The brush portion receives liquid toner between its bristles, and is compressed in the contact area between the brush portion and the feed member. The brush portion will remove any contamination on the surface of the feed member, will agitate the liquid toner in and around the contact area, and will ensure that an entirely fresh layer of liquid toner is applied on the feed member when being immersed in the liquid toner in the reservoir.

Preferably the feed assist member is a feed assist roller having an axis which is mounted using bearings. In a possible embodiment the bearings may be provided in the reservoir. The bearings may be mounted using spring means arranged for pressing the feed assist member against the feed member with a predetermined pressure, which is independent of the extent to which the contact portion of the feed assist member is compressed by the feed member. In another embodiment the axis of the feed assist roller extends through two opposite walls of the reservoir into bearings provided outside the reservoir. Appropriate sealing means are provided between the axis and the walls of the reservoir. In yet another embodiment there may be provided an auxiliary reservoir surrounding the reservoir, and the bearings may be provided in the auxiliary reservoir. In such an embodiment sealing means will not be as critical as in the previous embodiment. In the embodiment with auxiliary reservoir, the bearings and the auxiliary reservoir may be spring-mounted with respect to the reservoir, so that the feed assist member is pressed against the feed member with a predetermined force, which is independent of the extent to which the contact portion of the feed assist member is compressed by the feed member.

According to another aspect of the invention, there is provided a storage system for liquid toner, comprising a reservoir for containing liquid toner, said reservoir being spring-mounted in an auxiliary reservoir. The reservoir is provided with a roller having an axis which is intended for extending below the level of liquid toner. The axis extends through opposite walls of the reservoir and is rotatably mounted using bearings which are spring-mounted in the auxiliary reservoir. The auxiliary reservoir is intended for containing liquid toner up to a level which is lower than the location of the bearings. In that way a roller having an axis extending in liquid toner in a reservoir can be spring-mounted whilst avoiding that the bearings are located in liquid toner.

In the embodiments disclosed above a system with one feed assist member has been disclosed. However, the skilled person understands that there may be provided in the reservoir a plurality of feed assist members in contact with the feed member. The plurality of feed assist members may contain rotating feed assist members and/or stationary feed assist members.

According to another aspect there is provided a digital printing apparatus comprising an embodiment of a system as disclosed above, and further comprising any one or more of the following features:

- an imaging member arranged for rotating in contact with the developing member;
- a charging member, typically a corona charger, opposite a surface of the developing member and/or opposite a surface of the feed member, upstream of a contact surface between the developing member and the imaging member;
- a discharging member arranged opposite the developing roller, downstream of an area of rotational contact between the developing member and the imaging member; this discharging member is preferably controlled to control the charge of excess liquid toner remaining on the developing member downstream of the contact area between the developing member and imaging member; this discharging member will also facilitate the operation of the feed assist member, since uncharged toner particles can be more easily removed from the feed roller;
- a scraper arranged opposite the developing member downstream of a contact surface between the developing member and the imaging member;
- a loosening member upstream of the scraper and downstream of a contact surface between the developing member and the imaging member, said loosening member being arranged to loosen liquid toner present on the developing member, wherein the loosening member has a rubbing portion arranged to rub the liquid toner to be loosened, said rubbing portion being arranged and configured for being compressed by the developing member and for being capable of at least partially containing or absorbing the liquid toner during compression by the developing member, wherein preferably the rubbing portion is made of an elastic foam material capable of absorbing liquid toner, wherein preferably the loosening member is configured to rotate in an opposite direction compared to the developing member, seen at an area of contact between the developing member and the loosening member, such that a liquid pick-up zone is created upstream of said area of contact and a squeeze-out zone is created downstream of said area of contact; such a loosening member will also facilitate the operation of the feed assist member, since less "dead" toner particles remain adhered to the developing member, and hence less such toner particles will be transferred to the feed member.

According to another aspect of the invention there is provided a method for applying liquid toner on a developing member. Liquid toner from a reservoir is applied on a rotating feed member and transferred by the feed member, typically an anilox roller, to a developing member. The applying of liquid toner on the rotating feed member comprises contacting a feed assist member in the reservoir in a contact area which is located in the liquid toner in the reservoir; such that the feed assist member is compressed in the contact area between the feed member and the feed assist member.

Preferably any contamination and/or trapped air on the feed member is removed whilst the feed member is in rotating contact with the feed assist member. Preferably the feed assist member is a feed assist roller or belt, and the feed member is a feed roller or belt. Preferably the feed assist roller or belt is rotated in the same direction as the feed roller, seen in the contact area, such that the liquid toner adjacent the feed roller is moved and agitated in the contact area. Preferably the feed assist roller or belt is rotated as a consequence of being in contact with the rotating feed roller or belt.

In a preferred embodiment the method of the invention is performed using an embodiment of a system or apparatus of the invention.

It will be understood that all features described in more detail in connection with embodiments of the system and apparatus of the invention, apply also to the method according to the invention, with the same technical effects and advantages. Hence, these features and their operation will not be repeated.

BRIEF DESCRIPTION OF THE DRAWINGS

These and other technical effects and advantages of embodiments of the present invention will be explained in more detail with reference to the accompanying drawings, in which.

DESCRIPTION OF THE INVENTION

Throughout this application, the terms "upstream" and "downstream" are used to designate relative positions along the path taken by the liquid toner on the respective surfaces of various rollers or members. Accordingly, the terms must be understood in the context of the direction of movement of the relevant surfaces: the term "upstream" designates a position traversed earlier than the position referred to and the term "downstream" designates a position traversed later than the position referred to. The skilled person shall understand that these terms do not necessarily correlate with the terms "up" and "down".

Figure 1:
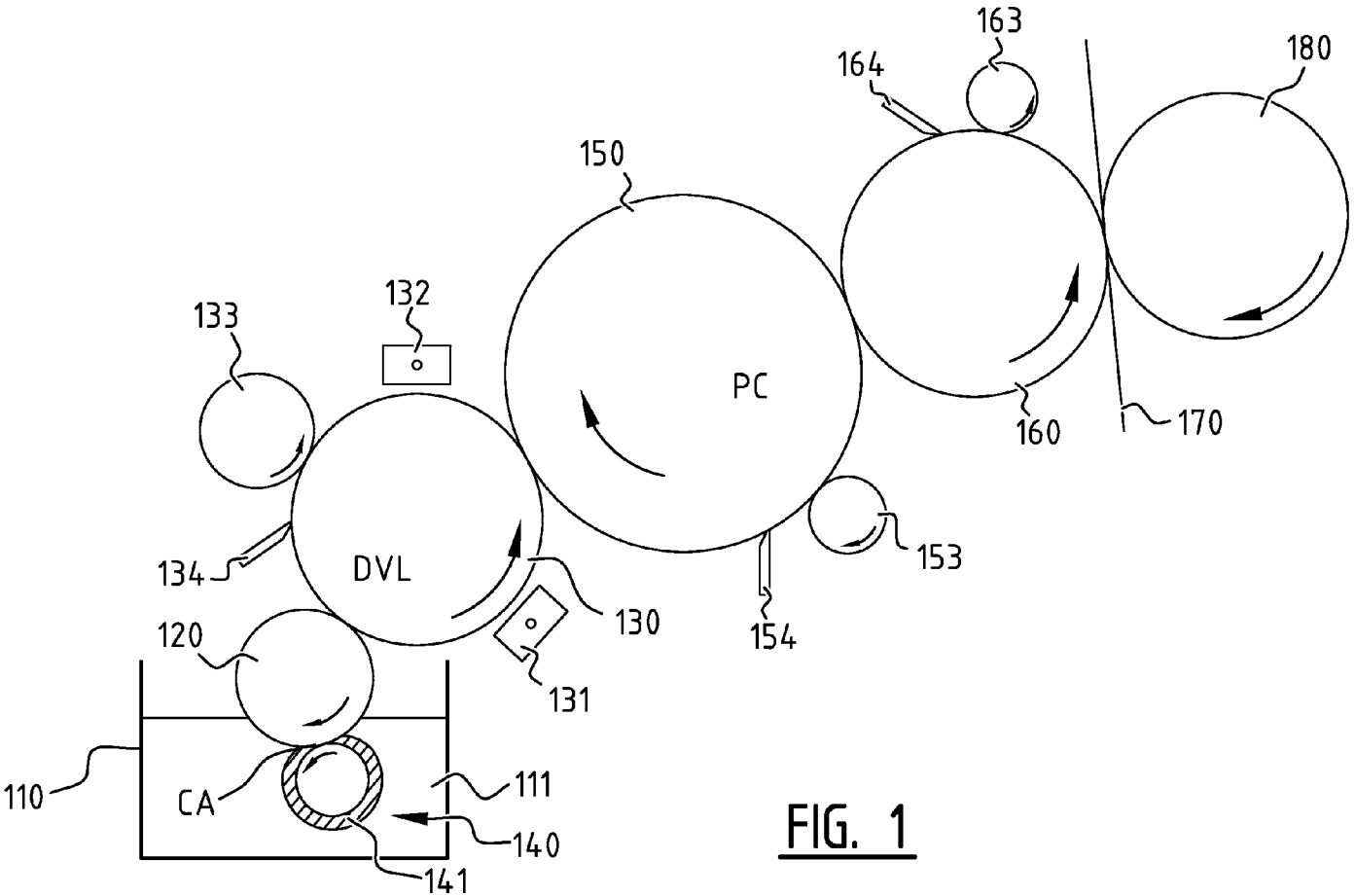
FIG. 1 schematically illustrates a first embodiment of a digital printing apparatus of the present invention.

FIG. 1 illustrates a first embodiment of a digital printing apparatus of the invention, comprising a reservoir 110, a feed assist member 140, a feed member 120, a developing member 130, an imaging member 150, a transfer member 160 and a support member 180. A substrate 170 is transported between transfer member 160 and support member 180. Without loss of generality, the aforementioned members are illustrated and described as rollers, but the skilled person understands that they can be implemented differently, e.g. as belts. The developing roller 130, the imaging roller 150, and the transfer roller 160 all transfer a part of the liquid toner adhering to their surface to their successor. The fraction of the liquid toner that remains present on the respective roller surface, is removed after the transfer by appropriate removal means 133, 134; 153, 154; 163, 164.

The illustrated digital printing apparatus comprises a system for applying liquid toner to the developing roller 130 including the reservoir 110 for storing liquid toner 111, the feed roller 120 and the feed assist roller 140. In the illustrated example the feed roller 120 is an anilox roller, e.g. an anilox roller with a tri-helical pattern. The anilox roller 120 and the feed assist roller are arranged in rotating contact with each other along a contact area CA which is located, when the system is operational, in the liquid toner 111 in the reservoir 110. In that way the rotatably driven feed roller 120 will cause the (not motorized) feed assist roller 140 to rotate. The feed assist roller 140 is provided with a compressible contact layer 141 arranged for being compressed in the contact area CA between the anilox roller 120 and the feed assist roller 140.

When a surface part of the anilox roller 120 arrives at the feed assist roller 140, this surface part first moves in a pressure zone where the pressure increases and next in a pressure relief zone where the pressure decreases. In the pressure zone any contamination and any trapped air is removed from the recesses of the anilox pattern. In the pressure relief zone fresh liquid toner 111 from the reservoir 110 fills the recesses of the anilox roller 120, wherein any removed air will be replaced by fresh liquid toner. The rotating feed assist roller 140 will cause the liquid toner 111 in the reservoir 110 to move in the area of the anilox roller 120 due to pressure variations and air migration. This movement will reduce significantly the viscosity of the liquid toner 111 facilitating the filling of the recesses in the anilox roller 120. Preferably the anilox roller 120 has an open anilox pattern such as a tri-helical anilox pattern. Such an open structure will facilitate the movement of the toner in the recesses of the anilox pattern.

In the illustrated example a corona charger 131 is provided opposite to the developing roller 130, downstream of an area of rotational contact between the feed roller 120 and the developing roller 130, and upstream of an area of rotational contact between the imaging roller 150 and the developing roller 130. In other embodiments the liquid toner stored in the reservoir may be intrinsically charged (precharged), in which case further charging may not be needed and the corona charger 131 may be omitted. A discharging corona 132 is provided downstream of the area of the rotational contact between the developing roller 130 and the imaging roller 150. Preferably, this discharging corona 132 is controlled in order to discharge the excess liquid toner remaining on the developing roller 130 after the transfer between the developing roller 130 and the imaging roller 150. Suitable implementations are disclosed in NL 2010573 in the name of the Applicant. Further, downstream of the discharge corona 132, there is provided a loosening roller 133 followed by a scraper 134. The loosening roller 133 and the scraper 134 may be embodied as disclosed in patent application EP 13 162 577.4 in the name of the Applicant. In a similar way, the imaging roller 150 and the transfer roller 160 may be provided with a loosening roller 153, 163 and a scraper 154, 164, respectively. Also for those rollers, the loosening roller could be preceded by a discharge corona. It is noted that the loosening rollers 133, 153, 163 and discharge corona 132 will typically facilitate the operation of the feed assist roller 140, but are optional in embodiments of the invention.

Although not illustrated, the apparatus of FIG. 1 may comprise additional reservoirs, as well as adding means configured for adding an amount of dispersing agent to the excess liquid developer dispersion; and control means for controlling the adding means such that the amount added is sufficient to reduce caking in the excess liquid developer dispersion. Such means are described in patent application NL2010581 in the name of the Applicant.

Figure 2A:
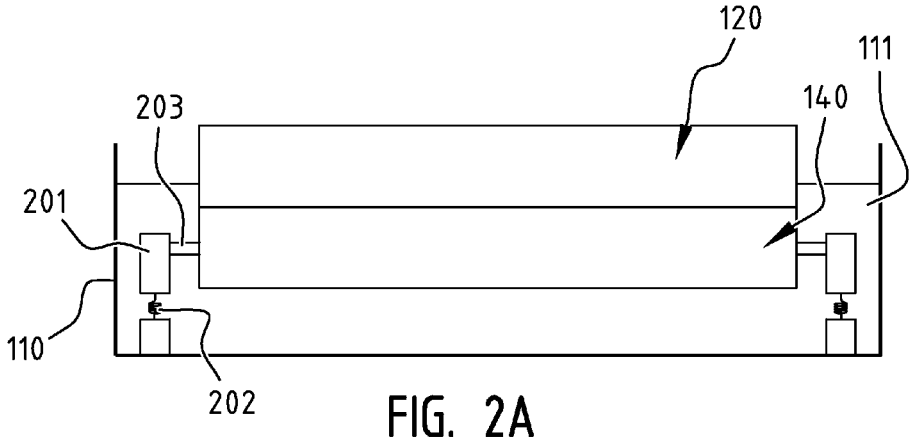
FIGS. 2A-2B illustrate two embodiments for mounting the feed assist roller of the first embodiment in the reservoir.
Figure 2B:
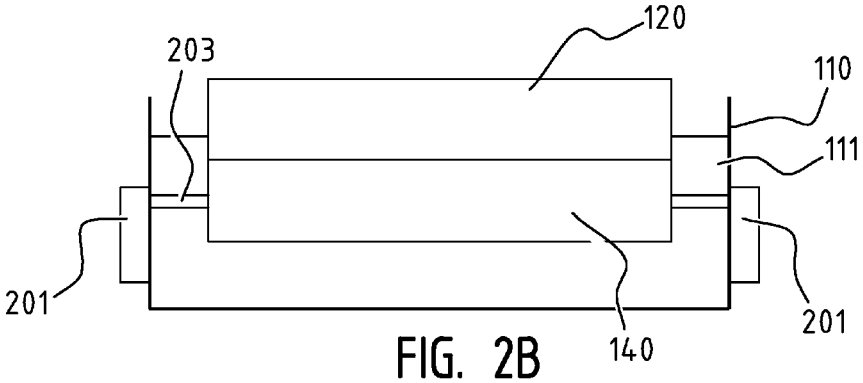

FIGS. 2A and 2B illustrate two possible embodiments for mounting the feed assist roller 140 of the first embodiment disclosed above. In the embodiment of FIG. 2A the feed assist roller 140 is mounted using bearings 201 provided inside the reservoir 110. The bearings 201 may be mounted using spring means 202 arranged for pressing the feed assist roller 140 against the anilox roller 120 with a predetermined force, which is independent of the extent to which the feed assist roller 140 is compressed by the feed roller 120. Such an embodiment has the advantage that leakage problems are avoided and that the contact area between the feed roller 120 and the feed assist roller 140 is well controlled. In the embodiment of FIG. 2B, the axis 203 of the feed assist roller 140 extends through two opposite walls of the reservoir 110 into bearings 201 provided outside the reservoir. Appropriate sealing means (not shown) are provided between the axis 203 and the walls of the reservoir 110.

Figure 2C:
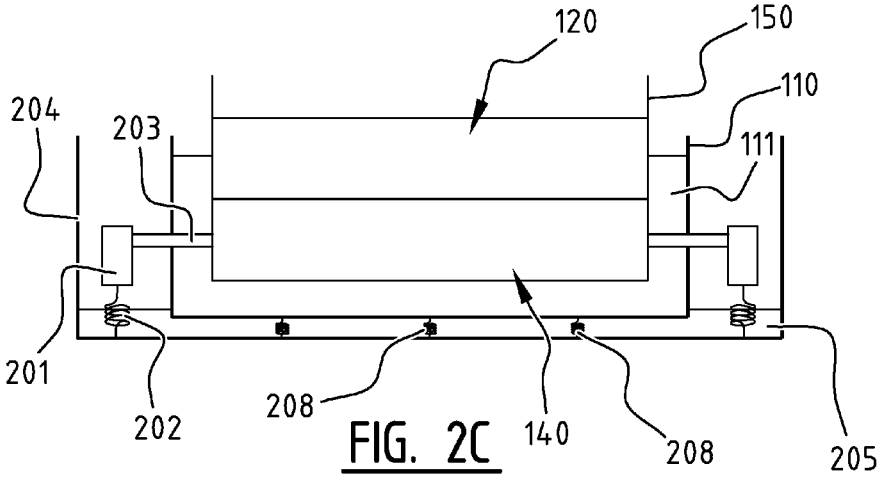
FIGS. 2C and 2D illustrate a longitudinal side view and a cross section of a further embodiment of a system of the invention, respectively.
Figure 2D:
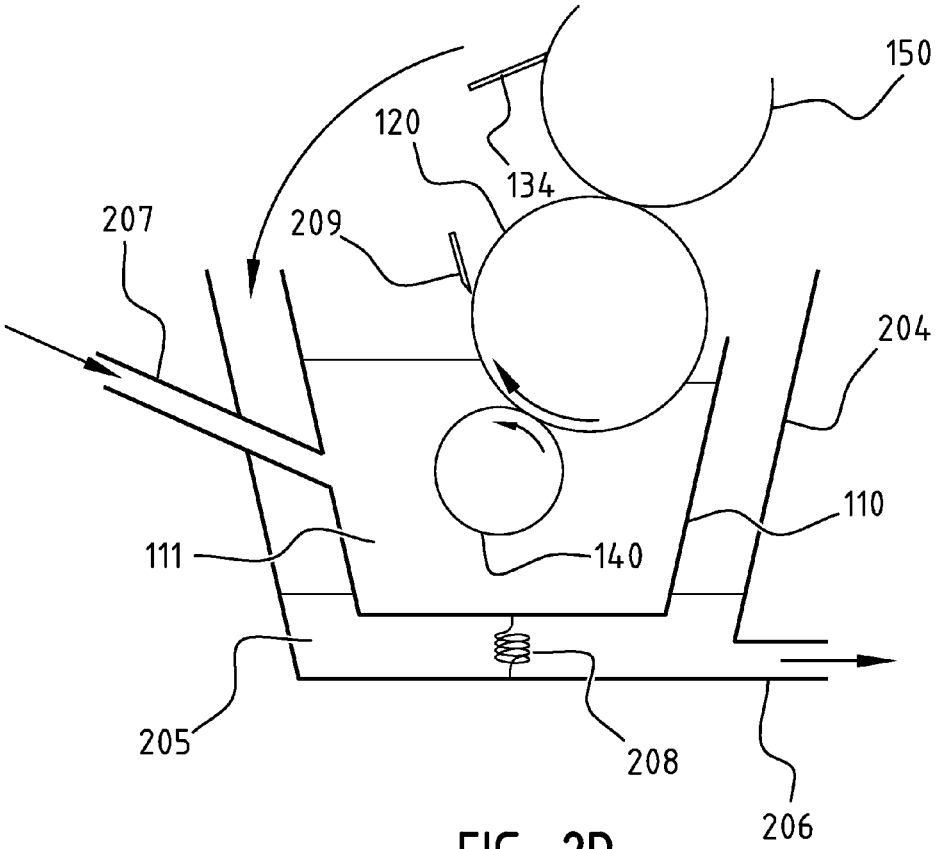

FIGS. 2C and 2D illustrate a further embodiment for mounting the feed assist roller 140 in the reservoir 110. In this embodiment the reservoir 110 is mounted in an auxiliary reservoir 204, and the bearings 201 are provided in the auxiliary reservoir 204. In such an embodiment sealing means will not be as critical as in the embodiment of FIG. 2B. The auxiliary reservoir 204 may function as a discharge reservoir having an outlet 206. The reservoir 110 has an inlet 207 for feeding fresh liquid toner in the reservoir 110. The level of liquid toner 205 in the auxiliary reservoir 204 is below the level of the bearings 201. The bearings 201 and the auxiliary reservoir 204 may be spring-mounted with respect to the reservoir 110 through spring means 202, 208, respectively, such that the feed assist roller 140 is pressed against the feed roller 120 with a predetermined force. In the illustrated embodiment there is provided a scraper 134 (see FIG. 2D, omitted in FIG. 2C) which is similar to the scraper 134 in FIG. 1. Liquid toner removed by scraper 134 may be discharged in the auxiliary reservoir. Also there may be provided an optional doctor blade 209 (see FIG. 2D, omitted in FIG. 2C) for removing an upper layer of the liquid toner layer that is applied by the feed roller 120. The auxiliary reservoir 204 may be implemented with mixing means, and may also function as any one of the additional reservoirs described in patent application NL2010581 in the name of the Applicant.

Figure 3:
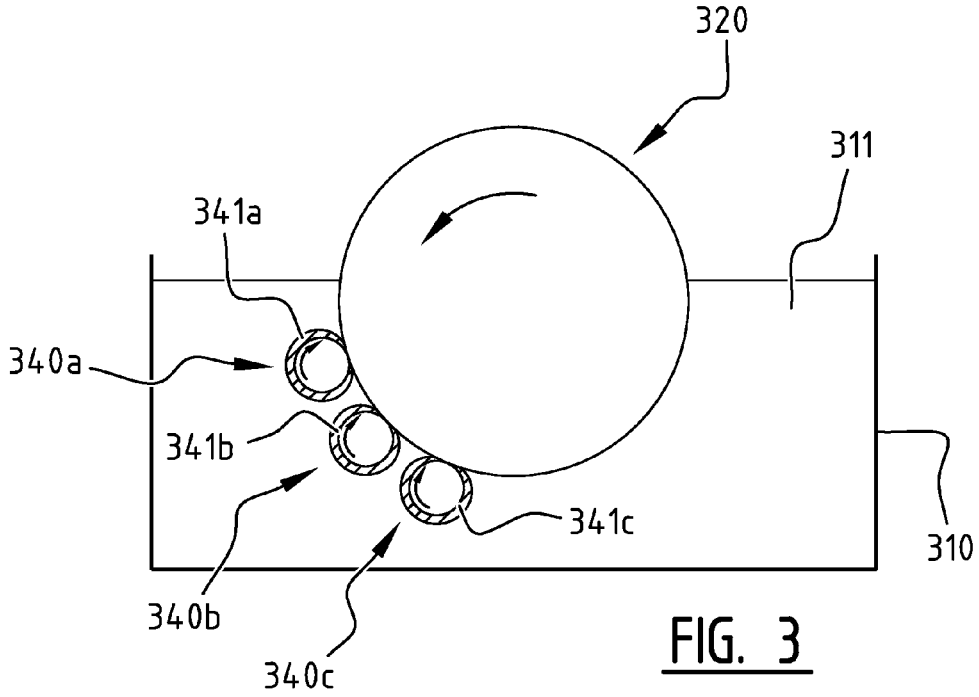
FIG. 3 illustrates a second embodiment of a system of the invention.

FIG. 3 illustrates a second embodiment of a system of the invention for providing liquid toner 311 from a reservoir 310 to a developing roller (not shown) rotating in contact with a feed roller 320, typically an anilox roller. In this embodiment three feed assist rollers 340*a*, 340*b*, 340*c* are provided. The three feed assist rollers 340*a*, 340*b*, 340*c* are mounted in the reservoir 310 for successively contacting the feed roller 320. The three feed assist rollers 340*a*, 340*b*, 340*c* may have identical contact portions 341*a*, 341*b*, 341*c*, but those contact portions could also be different, e.g. made from a different material, in order to further optimize the removal of contaminations/air and to further improve the application of fresh liquid toner on the feed roller 320.

Figure 4:
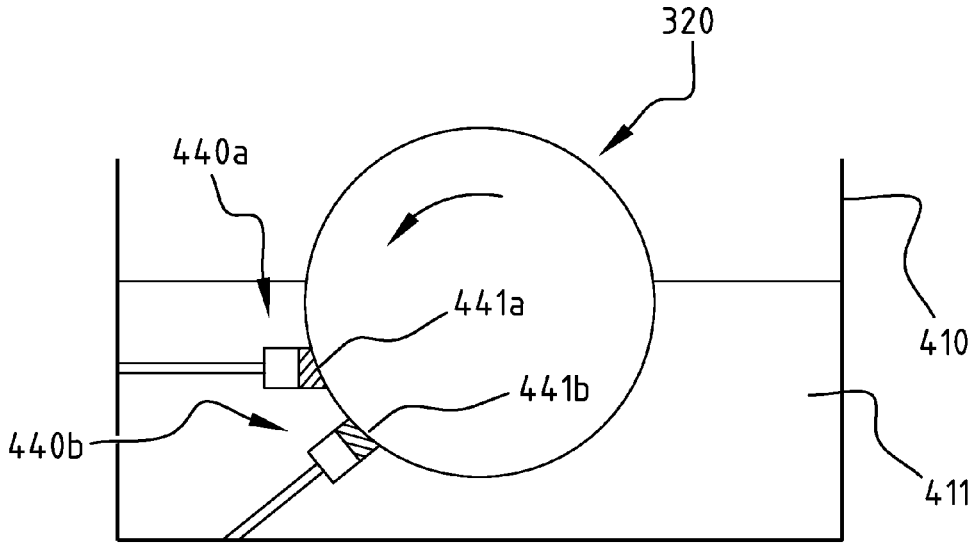
FIG. 4 illustrates a third embodiment of a system of the invention.

FIG. 4 illustrates a third embodiment of a system of the invention for providing liquid toner 411 from a reservoir 410 to a developing roller (not shown) rotating in contact with a feed roller 420, typically an anilox roller. In this embodiment two stationary feed assist members 440*a*, 440*b* are provided. The two feed assist members 440*a*, 440*b* are mounted in the reservoir 410 for successively contacting the feed roller 420. The two feed assist members 440*a*, 440*b* may have identical or different contact portions 441*a*, 441*b*.

In other non-illustrated embodiments one or more stationary feed assist members may be combined with one or more rotatable feed assist member. The contact portions thereof may be made from an open-cell material such as a foam, but could also take the form of a brush with polymer bristles, or of a contact layer with a ribbed outer surface such that liquid toner can be received between adjacent ribs, etc. More generally any contact portion capable of providing the feed assist function may be used.

The inventors have observed a significant improvement of the application of liquid toner on the feed member in embodiments of a system according to the invention. A test has been performed for an embodiment of an apparatus of the invention using an anilox roller having a tri-helical pattern. The test was performed with and without a feed assist roller. The feed assist roller had a PU outer layer having an Asker C hardness of approximately 25. The apparatus was in operation for eight hours. Without the feed assist roller, after eight hours, 20% less liquid toner was applied on the anilox roller compared to amount applied at the beginning of the operation. With the feed assist roller, the reduction was less than 5% instead of 20%, illustrating a significant improvement of the system for applying liquid toner on the anilox roller.

Although the invention has been described hereinabove with reference to specific embodiments, this has been done to illustrate and not to limit the invention, the scope of which is to be determined on the basis of the appended claims. For reasons of clarity, certain features have only been disclosed or described in detail in the context of a particular embodiment. The skilled person will appreciate that these features can be reused with the same technical effects and advantages in systems and apparatus according to other embodiments of the present invention, and such other combinations are expressly envisaged.

The invention claimed is:

1. A system for applying liquid toner to a developing member in a digital printer, the system comprising a reservoir for storing liquid toner, a feed member and a developing member, the feed member being arranged to rotate to transfer liquid toner from the reservoir to the developing member, the system comprising a feed assist member; wherein the feed member is arranged for rotating in contact with the feed assist member and making contact with the feed assist member along a contact area which is located, when the system is operational, in the liquid toner in the reservoir; and wherein the feed assist member is provided with a compressible contact portion arranged for being compressed in the contact area between the feed member and the feed assist member.

2. The system of claim 1, wherein the feed member is an anilox roller.

3. The system of claim 1, wherein the compressible contact portion has an Asker C hardness between 10 and 50, preferably between 15 and 45, more preferably between 20 and 30.

4. The system of claim 1, wherein the compressible contact portion is manufactured from a foam material.

5. The system of claim 1, wherein the feed assist member is arranged for rotating in the same direction as the feed member, seen at the contact area between the feed member and the feed assist member.

6. The system of claim 1, wherein the feed assist member is arranged for being rotated through contact with the feed member.

7. The system of claim 1, wherein the contact portion is adapted to absorb liquid toner by capillary action.

8. The system of claim 1, wherein the feed assist member is a feed assist roller or belt.

9. The system of claim 1, wherein the feed assist member is a feed assist roller mounted using bearings provided in the reservoir.

10. The system of claim 9, wherein said bearings are mounted with spring means arranged for pressing the feed assist roller against the feed member with a predetermined pressure.

11. The system of claim 1, wherein the reservoir is placed in an auxiliary reservoir, and the feed assist member is a feed assist roller mounted using bearings provided in the auxiliary reservoir, said bearings and said auxiliary reservoir optionally being spring-mounted with respect to the reservoir, such that the feed assist roller is pressed against the feed member with a predetermined force.

12. A system for applying liquid toner to a developing member in a digital printer, the system comprising a reservoir for storing liquid toner, a feed member and a developing member, the feed member being arranged to rotate to transfer liquid toner from the reservoir to the developing member, the system comprising a feed assist member; wherein the feed member is arranged for rotating in contact with the feed assist member and making contact with the feed assist member along a contact area which is located, when the system is operational, in the liquid toner in the reservoir; wherein the feed assist member is provided with a compressible contact portion arranged for being compressed in the contact area between the feed member and the feed assist member; wherein said compressible contact portion is provided in a material with an open cell structure; and wherein the feed assist member is arranged for rotating in the same direction as the feed member, seen at the contact area between the feed member and the feed assist member.

13. The system of claim 12, wherein the feed member is an anilox roller.

14. The system of claim 12, wherein the feed assist member is arranged for being rotated through contact with the feed member.

15. The system of claim 12, wherein the contact portion is adapted to absorb liquid toner by capillary action.

16. A digital printing apparatus comprising a system according to claim 12, an imaging member arranged for rotating in contact with the developing member, and a charging member opposite a surface of the developing member and/or opposite a surface of the feed member, upstream of a contact surface between the developing member and the imaging member.

17. The digital printing apparatus according to claim 16, further comprising a discharging member arranged opposite the developing roller, downstream of an area of rotational contact between the developing member and the imaging member; and/or a scraper arranged opposite the developing member downstream of a contact surface between the developing member and the imaging member; and/or a loosening member upstream of the scraper and downstream of a contact surface between the developing member and the imaging member, said loosening member being arranged to loosen liquid toner present on the developing member, wherein the loosening member has a rubbing portion arranged to rub the liquid toner to be loosened, said rubbing portion being arranged and configured for being compressed by the developing member and for being capable of at least partially containing or absorbing the liquid toner during compression by the developing member.

18. A method for applying liquid toner on a developing member, said method comprising: applying liquid toner from a reservoir on a rotating feed member and transferring the liquid toner applied on the feed member at least partially to a developing member; wherein applying liquid toner on the rotating feed member comprises contacting a feed assist member in the reservoir in a contact area which is located in the liquid toner in the reservoir; such that the feed assist member is compressed in the contact area between the feed member and the feed assist member.

19. The method of claim 18, wherein the feed assist member, preferably a feed assist roller or belt, is rotated in the same direction as the feed member, preferably an anilox roller, seen in the contact area, such that the liquid toner adjacent the feed member is agitated in the contact area.

20. The method of claim 18, wherein the feed assist member has a compressible contact portion having an Asker C hardness between 10 and 50, preferably between 15 and 45, more preferably between 20 and 30; said compressible contact portion preferably being manufactured from a foam material adapted to absorb liquid toner by capillary action.

* * * * *